United States Patent [19]

Hale et al.

[11] Patent Number: 4,937,433

[45] Date of Patent: Jun. 26, 1990

[54] ELECTRICAL HEATING UNIT FOR SEALING VACUUM ELECTRON TUBES

[75] Inventors: John R. Hale, East Hempfield Twp, Lancaster County; Earl R. Stahl, Mount Joy; Jack H. Davis, East Hempfield Twp., Lancaster County; Gregory C. Madensky, Clarks Summit, all of Pa.

[73] Assignee: RCA Licensing Corporation, Princeton, N.J.

[21] Appl. No.: 400,913

[22] Filed: Aug. 30, 1989

[51] Int. Cl.[5] ..... H05B 3/64

[52] U.S. Cl. ..... 219/385; 219/535; 219/201

[58] Field of Search ..... 219/385, 386, 390, 535, 219/200, 201; 65/34, 269, 270

[56] References Cited

U.S. PATENT DOCUMENTS

| | | | |
|---|---|---|---|
| 2,273,441 | 2/1942 | Gustin | 65/270 |
| 2,278,500 | 4/1942 | Smith | 65/270 |
| 2,986,846 | 6/1961 | Clarke et al. | 219/385 |
| 3,002,076 | 9/1961 | Massey . | |
| 3,100,251 | 8/1963 | Johnson . | |
| 4,451,725 | 5/1984 | Mount | 219/390 |

*Primary Examiner*—Teresa J. Walberg

*Attorney, Agent, or Firm*—Joseph S. Tripoli; Dennis H. Irlbeck; Vincent J. Coughlin, Jr.

[57] ABSTRACT

The heating unit for sealing vacuum electron tubes of the type having a glass stem, a glass exhaust tubulation extending from the stem and a plurality of electrically-conducting leads extending from the stem in a circular array around the tabulation includes a cylindrical heating coil within a coil recess of an electrically-insulating coil support. The coil recess circumscribes a central aperture within the coil support. The coil support has a first and a second surface with a coil-positioning lip projecting upwardly from the second surface thereof and circumscribing the central aperture. A hollow, substantially cylindrical, tubulation-locator having an outwardly extending flange formed in an outside surface thereof is disposed between the second surface of the coil support and a base plate. The locator also includes a centering collar formed in its outside surface and a tubulation centering aperture formed in the inside surface. A top plate is adjacent to the first surface of the coil support. The top plate has an aperture with a diameter greater than the diameter of the circular array of leads extending from the glass stem. A coil centering annular coil guide is formed in the top plate. A stem support disposed on the top plate includes a plurality of stem-contacting members which support the stem and establish the longitudinal position of the tubulation within the heating coil.

11 Claims, 1 Drawing Sheet

ELECTRICAL HEATING UNIT FOR SEALING VACUUM ELECTRON TUBES

This invention relates to a novel electrical heating unit for use in sealing vacuum electron tubes and particularly, but not necessarily exclusively, for tipping-off cathode-ray tubes immediately after they are exhausted of gases.

BACKGROUND OF THE INVENTION

In the manufacture of vacuum electron tubes, it is a common practice to provide an envelope having a small glass exhaust tubulation. During the manufacture of the tube, the envelope is exhausted of gases through the tubulation. Then, the tubulation is heated to melt the glass at a location that is close to the external surface of the envelope. The molten glass necks in, closing the path therethrough, and thereby seals the interior of the envelope from the ambient. This sealing of the tubulation is referred to in the art of "tipping-off".

In many types of tubes, including most cathode-ray tubes, the exhaust tubulation is integral with the stem of the tube. The stem includes a glass disc on wafer having a circular array of electrically-conducting leads sealed into, and extending out from, the wafer, with the exhaust tubulation usually disposed centrally of, and within the array of, the leads. The glass of the wafer is usually thicker adjacent each lead, which thickening is referred to as a "fillet".

A typical heating unit used for tipping-off exhaust tubulations comprises a cylindrical electrical resistance heater coil sized to fit symmetrically around the outside of the circular array of leads, with the stem of the tube resting on the top of the endwall of the unit. One type of heater unit, described in U.S. Pat. No. 3,002,076 issued Sept. 26, 1961 to M. K. Massey, includes separate metal straps that function as heat shields between each lead and the heater coil in a circular array. Factory use of the prior heater units has been satisfactory generally, although an undesirable percentage of tubes has exhibited cracked fillets and/or nonsymmetrical melting of the exhaust tubulation.

U.S. Pat. No. 4,451,725 issued May 29, 1984 to J. Mount reduces the above-mentioned problems by providing a heat shield that includes a unitary body of heat conducting material having a hollow, cylindrical main body with an inwardly-extending flange at one end and an outwardly-extending flange at the other end thereof. The wall of the main body is shorter than the length of the longest lead so that the longest lead, or leads, rests on the lower, inwardly-directed flange. The lower flange has an aperture therethrough that is large enough for the tubulation to pass through but smaller than the circle of leads through the stem. A drawback of this latter structure is that the lower flange which contacts one or more leads, tends to bend the leads, and the lead-supporting heat shield requires a great deal of electrical power to develop a good tip-off. Additionally, as the heat shield oxidizes, holes develop therein which create hot-spots in the tubulation and asymmetric seals which have unequal stress and are subject to failure. Another drawback of the patented structure is the cylindrical ceramic heater retainer, which is located concentrically around the coil, is a separate structure that is free to move and thus permits an outward movement of the coil which results in non-symmetric heating of the tubulation. Accordingly, a need exists for a heating unit which is free from the sealing problems encountered in the prior structures.

SUMMARY OF THE INVENTION

The novel heating unit for sealing vacuum electron tubes of the type having a glass stem, a glass exhaust tubulation extending from the stem and a plurality of electrically-conducting leads extending from the stem in a circular array around the tubulation includes a cylindrical heating coil within a coil recess of an electrically-insulating coil support. The coil recess circumscribes a central aperture within the coil support and restricts the outward movement of the coil. The coil support has a first and a second surface with a coil-positioning lip projecting upwardly from the second surface thereof and circumscribing the central aperture. A base plate having a base plate aperture therethrough is adjacent to the second surface of the coil support. A hollow, substantially cylindrical, tubulation-locator having locator support means formed in an outside surface thereof is disposed between the second surface of said coil support and said base plate, with at least a portion of the locator within the base plate aperture. The locator also includes locator centering means formed in the outside surface thereof and tubulation centering means formed in the inside surface. A top plate is adjacent to the first surface of the coil support. The top plate has a first surface and a second surface with a top plate aperture therethrough. The top plate aperture has a diameter greater than the diameter of the circular array of leads extending from the glass stem. Coil centering means is formed in the second surface of the top plate. A stem support disposed on the first surface of the top plate includes a plurality of stem-contacting members which support the stem and establish the longitudinal position of the tubulation within the heating coil. Attachment means are provided for securing together the elements of the heating unit.

DETAILED DESCRIPTION OF THE PREFERRED EMBODIMENT

Figure 1:
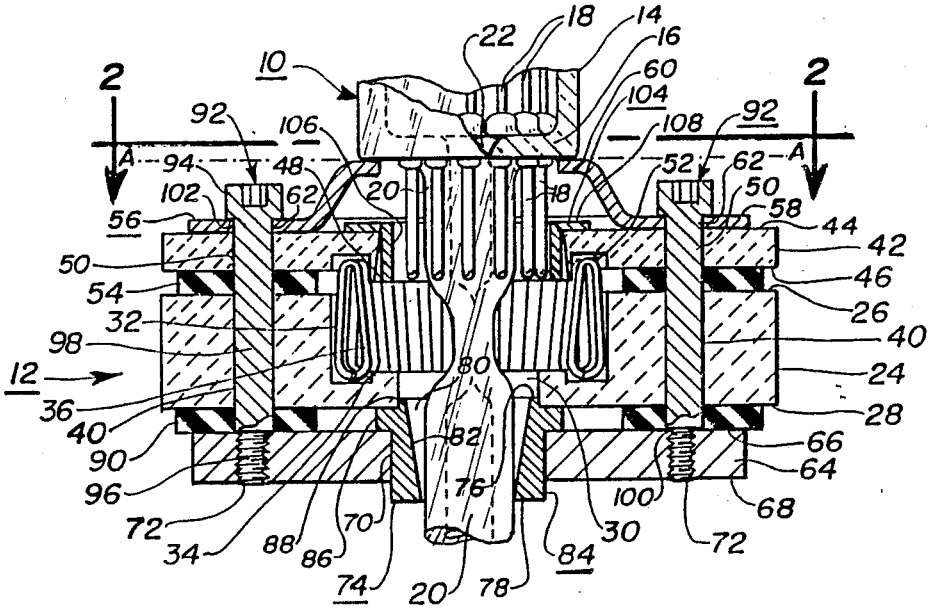
FIG. 1 is an enlarged, partially sectional, elevational view of an electrical heating unit for sealing vacuum electron tubes according to the present invention.
Figure 2:
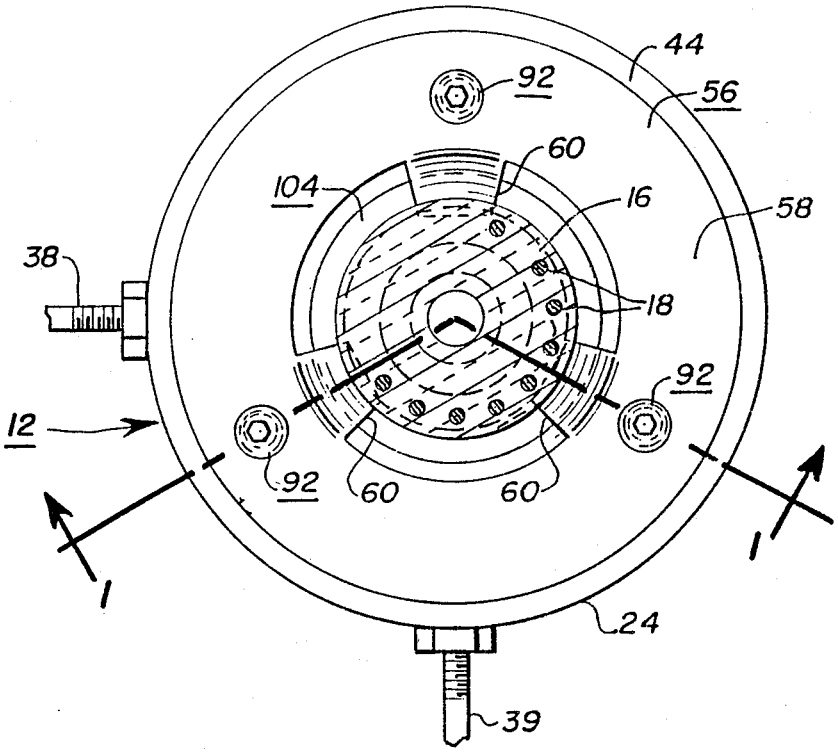
FIG. 2 is a top view taken along line 2—2 of FIG. 1.

Shown in FIGS. 1 and 2, is a portion of a vacuum electron tube 10, such as a cathode-ray tube, that is suitable for sealing or tipping-off with a novel electrical heating unit 12. The portion of the tube shown in FIG. 1 includes a tubular neck 14 which is closed at one end by a glass stem 16 through which a circular array of electrically-conducting leads 18 extend. A hollow cylindrical exhaust tubulation 20 is sealed into the stem 16 concentrically within the array of leads 18 and provides a passage 22 through the stem 16 for exhausting the interior of the tube 10 of gases.

The unit 12 includes a cylindrical coil support 24 of an electrically-insulating material, such as ceramic. The coil support 24 has an upward-facing first surface 26 and a downward-facing second surface 28. A central aperture 30 extends through the coil support 24 from the first surface 26 to the second surface 28. A coil recess 32 is formed partially through the coil support 24 from the first surface thereof. The coil recess 32 circumscribes the central aperture 30 and forms a coil-positioning lip 34 projecting upwardly from the second surface 28 between the recess 32 and the central aperture 30. A cylindrical resistance-heating coil 36 is disposed within the coil recess 32 and a pair of electrical leads 38 and 39, shown in FIG. 2, extend from the coil support 24 for applying a voltage to the coil 36. Preferably, the coil 36 is wound back-and-forth parallel to the length of the tubulation 20. This type of coil winding facilitates utilizing the coil-positioning lip 34 and the wall of the recess to retain and center the coil 36 within the coil recess 32 and thereby provide uniform, symmetric heating of the tubulation 20. A plurality of attachment apertures 40 are formed in the body of the coil support 24 for a purpose described hereinafter.

A top plate 42 of an insulating material, e.g. ceramic, is disposed adjacent to the first surface 26 of the coil support 24. The top plate 42 has a first surface 44 and a second surface 46 with a centrally disposed top plate aperture 48 therethrough. The top plate aperture 48 has a diameter adjacent the first surface 44, that is greater than the diameter of the circulator array of leads 18 extending from the stem 16. The diameter of the aperture 48 increases towards the second surface 46 to decrease the thermal mass of the top plate 42 and thereby reduce the heat flux from the coil 36 intercepted by the top plate. A plurality of top plate attachment apertures 50 also are formed through the top plate 42 and are configured to align with the attachment apertures 40 in the coil support 24. An annular coil guide 52, which circumscribes the top plate aperture 48, is formed in the second surface 46 of the top plate 42 to retain and center the coil 36 within the unit 12. A first annular spacer 54 is disposed between the top plate 42 and the coil support 24. The spacer is preferably made of an insulating material, such as mica, and has a thickness sufficient to retain the coil 36 within the coil guide 52 without compressing the coil.

A stem support 56 is disposed on said first surface 44 of said top plate 42. The stem support 567 includes an annular base portion 58 in contact with said first surface 44 and a plurality of stem contacting members 60 extending inwardly from the base portion 58. The members 60 preferably lie in a plane A parallel to but spaced from the first surface 44 of the top plate 42. The height or distance of the plane A above the first surface 44 establishes the longitudinal position of the tubulation 20 within the heating coil 36 and thus determines the length of the "tipoff". A plurality of stem support attachment apertures 62 are found through the annular base portion 58 and aligned with the attachment apertures 50 in the top plate 42.

A base plate 64 having a first surface 66 and an oppositely disposed second surface 68 is positioned so that the first surface 66 of the base plate 64 is adjacent to the second surface 28 of the coil support. A centrally disposed base plate aperture 70 is formed through the plate 64. A plurality of threaded holes 72 also are formed through the plate 64 in alignment with the attachment apertures through the various elements of the unit 12.

The unit 12 further includes a hollow, substantially cylindrical, tubulation locator 74. The locator 74 includes a top end 76, a bottom end 78 and a tubulation centering aperture 80 formed in an inner surface 82. The diameter of the tubulation centering aperture 80 decreases with increasing distance from the top end 76. The funnel-shaped inner surface 82 serves to radially position the tubulation 20 coaxially within the coil 36. The tubulation locator 74 has an outer surface 84 which includes an outwardly extending flange 86 which supports the tubulation locator 74 between the second surface 28 of the coil support 24 and the first surface 66 of the base plate 64. The locator 74 also includes a collar 88 disposed within the central aperture 30 of the coil support 24 and along at least a portion of the coil-positioning lip 34 which circumscribes the aperture 30 for centering the tubulation locator relative to the coil support 24. At least a portion of the tubulation locator, extending below the flange 86, is disposed within the base plate aperture 70. A second annular spacer 90 is disposed between the second surface 28 of the coil support 24 and the first surface 66 of the base plate 64. The second spacer 90 is preferably made of an insulating material, such as mica, and has a thickness at least equal to, or slightly greater than, the height of the outwardly extending flange 86 formed in the outer surface of the tubulation locator 74.

The elements of the unit 12 are secured together as a unit by means of a plurality of shoulder screws 92. Each of the screws 92 has a head end 94, an attachment end 96 and a shaft 98 extending therebetween. The attachment end 96 is threaded to mate with the threaded holes 72 in the base plate 64. The shaft 98 has a diameter sufficiently greater than that of the attachment end 96 so that a shoulder 100 of the shaft abuts the base plate 64. Similarly, the head end 94 of each screw has a diameter greater than that of the shaft 98 so that a shoulder 102 of the head end 94 abuts the annular base portion 58 of the stem support 56. The abutting shoulders 100 and 102 prevent overtightening of the screws 92 which can cause cracking of the insulating elements of the unit 12.

A thermal shield 104 comprising a unitary member of heat-conducting material, such as stainless steel, having a hollow cylindrical body 106 with an outwardly-extending flange 108 at one end thereof may be utilized to prevent non-uniform heating of the tubulation 20 due to an asymmetric placement of the leads 18 within the stem 16. The stem is designed to accommodate as many as fourteen leads; however, for many types of tubes the electron guns are of a design requiring fewer leads to support and provide voltages to the electrodes thereof. FIG. 2. shows a nine-lead stem in which the leads 18 are asymmetrically arranged around the stem 16. Such a lead configuration requires the use of the thermal shield 104. Again with reference to FIG. 1, the cylindrical body 106 encircles the leads 18 and the outwardly-extending flange 108 is disposed on the first surface 44 of the top plate 42 with the body 106 extending at least partially within the top plate aperture 48.

The novel unit 12 may be used by the following procedures. The tubulation 20 of the tube 10 is carefully passed downward through the hollow body 106 of the thermal shield 104 and the central aperture 30 of the coil support 24 into the centering aperture 80 of the tubulation locator 74. The outer periphery of the stem 16 rests on the upstanding stem contacting members 60 of the stem support 56. In this configuration the leads 18 are suspended within the unit 12 but do not contact any element of the unit thereby eliminating the possibility of bent pins. A vacuum connection (not shown) is made to the free end of the tubulation 20, and the tube 10 is exhausted of gases, typically to a vacuum of about $10^{-5}$ torr. The tube is then baked at a suitable temperature, e.g., about 400° C., during the period when it is being exhausted. With the tube under vacuum, a voltage is applied to the electrical leads 38, 39 which are attached to the coil 36 to bring the coil to operating temperature. The thermal shield 104 shields the leads 18 from overheating and serves to concentrate the heat on the tubulation 20 below the heat shield. This reflected heat and the direct radiation from the coil 36 causes the glass of the tubulation 20 in that region to melt whereby the ambient atmospheric pressure collapses the molten glass as shown in FIG. 1, closing and sealing the passage 22 through the tubulation 20. The voltage then is removed from the coil 36, the tubulation 20 is cooled, and the tube is removed from the unit 12. The excess tubulation is removed and the tube 10 is ready for additional processing as is known in the art.

What is claimed is:

1. In an electrical heating unit for sealing vacuum electron tubes of the type having a glass stem, a glass exhaust tubulation extending from said stem and a plurality of electrically-conducting leads extending from said stem in a circular array around said tubulation, said unit including the following elements:

(a) a cylindrical resistance-heating coil;

(b) an electrically-insulating coil support having a coil recess circumscribing a central aperture, said coil support having a first and a second surface; p1

(c) a base plate adjacent to said second surface of said coil support, said base plate having a base plate aperture therethrough;

(d) a top plate adjacent to said first surface of said coil support, said top plate having a first and a second surface with a top plate aperture therethrough, said top plate aperture having a diameter greater than the diameter of said circular array of leads extending from said stem;

(e) a stem support disposed on said first surface of said top plate for positioning said tubulation within said heating unit; and (f) attachment means for securing elements (a) through (e) together, the improvement comprising:

(i) said coil support having a coil-positioning lip projecting upwardly from said second surface and circumscribing said central aperture;

(ii) a hollow, substantially cylindrical, tubulation locator having locator support means and locator centering means formed in an outside surface and tubulation centering means formed in an inside surface thereof; said locator support means being disposed between said second surface of said coil support and said base plate, at least a portion of said locator being disposed within said base plate aperture;

(iii) said top plate having coil-centering means formed in said second surface thereof; and iv) said stem support having a plurality of stem-contacting members which support said stem and establish the longitudinal position of said tubulation within said heating coil.

2. The unit defined in claim 1 wherein said locator centering means includes a collar disposed within said central aperture of said coil support and extending along at least a portion of said coil-positioning lip.

3. The unit defined in claim 1 wherein said locator support means of said tubulation locator includes an outwardly-extending flange.

4. The unit defined in claim 1 wherein said tubulation centering means comprising a centering-aperture of decreasing diameter circumscribed by said inside surface of said tubulation locator.

5. The unit defined in claim 1 wherein said coil-centering means includes a coil guide circumscribing said top plate aperture.

6. The unit defined in claim 5 wherein said top plate aperture increases in diameter from said first to said second surface of said top plate thereby decreasing the thermal mass of said top plate and reducing the heat flux from said heating coil intercepted by said top plate.

7. The unit defined in claim 1 wherein said attachment means include protective stop means which contact said base plate and said stem support to prevent damage to said top plate and said coil support.

8. The unit defined in claim 1 further including a thermal shield disposed within said top plate aperture and encircling said leads of said stem.

9. The unit defined in claim 8 wherein said thermal shield comprises a unitary member of heat-conducting material including a hollow cylindrical body adapted to receive said leads therein and an outwardly-extending flange at one end thereof for contacting said first surface of said top plate, said cylindrical body encircling said leads to prevent non-uniform heating of said tubulation due to asymmetric lead placement within said stem.

10. The unit defined in claim 1 further including a first spacer disposed between said second surface of said top plate and said first surface of said coil support.

11. The unit defined in claim 1 further including a second spacer disposed between said second surface of said coil support and said base plate.

* * * * *

UNITED STATES PATENT AND TRADEMARK OFFICE
CERTIFICATE OF CORRECTION

PATENT NO. : 4,937,433

DATED : June 26, 1990

INVENTOR(S) : John R. Hale et al.

It is certified that error appears in the above-identified patent and that said Letters Patent is hereby corrected as shown below:

Title page, Abstract, 5th line,
change
"tabulation" to --tubulation--.

Col. 3, line 38,
change "567" to --56--.

Col. 5, line 23,
delete "pl".

Signed and Sealed this

Third Day of September, 1991

*Attest:*

HARRY F. MANBECK, JR.

*Attesting Officer*

*Commissioner of Patents and Trademarks*